US008528369B2

(12) United States Patent
Arzate Silva et al.

(10) Patent No.: US 8,528,369 B2
(45) Date of Patent: Sep. 10, 2013

(54) GEOMETRIC CONFIGURATION OF TUB

(75) Inventors: Alejandro Arzate Silva, Santiago de Queretaro (MX); Luis Ballesteros Martinez, Santiago de Queretaro (MX)

(73) Assignee: Mabe, S.A. de C.V., Queretaro (MX)

( * ) Notice: Subject to any disclaimer, the term of this patent is extended or adjusted under 35 U.S.C. 154(b) by 255 days.

(21) Appl. No.: 12/875,535

(22) Filed: Sep. 3, 2010

(65) Prior Publication Data

US 2011/0146357 A1 Jun. 23, 2011

(30) Foreign Application Priority Data

Dec. 17, 2009 (MX) ..... MX/a/2009/013992

(51) Int. Cl.
*D06F 37/26* (2006.01)

(52) U.S. Cl.
USPC ..... 68/212

(58) Field of Classification Search
USPC ..... 68/212
See application file for complete search history.

(56) References Cited

FOREIGN PATENT DOCUMENTS

| | | | | |
|---|---|---|---|---|
| AU | 2006235808 | A1 | | 5/2007 |
| EP | 1 783 263 | A2 | | 5/2007 |
| EP | 1 783 264 | A2 | | 5/2007 |
| EP | 1783264 | A2 | * | 5/2007 |
| KR | 2003-0055970 | | * | 7/2003 |
| KR | 20030055968 | A | | 7/2003 |
| KR | 20040046974 | A | | 6/2004 |

* cited by examiner

*Primary Examiner* — Michael Kornakov
*Assistant Examiner* — Jason Riggleman
(74) *Attorney, Agent, or Firm* — Enrique J. Mora; Beusse Wolter Sanks Mora & Maire, P.A.

(57) ABSTRACT

In a household washer which contains a tub with a cylindrical wall suspended by means of suspension rods, the tub also is comprised of ears with petals by which the tub is held in one extreme by suspension rods, at least one cylindrical reinforcement which surrounds the cylindrical wall, at least one pair of lobes in a substantially upper area of the tub, and additionally preferably one spout for over-flow in a substantially upper area of the tub.

11 Claims, 9 Drawing Sheets

GEOMETRIC CONFIGURATION OF TUB

RELATED APPLICATIONS

This application claims priority from Mexican application Serial No. MX/a/2009/013992 filed Dec. 17, 2009, which is incorporated herein by reference in its entirety.

FIELD OF INVENTION

The present invention falls under the washer category, in particular that of top loading washers and even more specifically; it applies to washers which has a metal cabinet, from which four fastened suspension rods hang each having a lower extremity comprised of a shock absorber; these are inserted into an equal number of disposable ears in the tub intended specifically for this purpose which in turn support the tub and additionally act as a good suspension system for the vibrations which are generated during the washing, rinsing and centrifuge motions. The tub holds in its interior a perforated basket, which itself contains an agitator in concentric form: the shaft of said agitator is mechanically connected to an electric motor which is suspended in the lower portion of the tub.

BACKGROUND

The tub not only holds the weight of the water and the articles to be washed, but also supports the static and dynamic charges which are generated with the washing or centrifuge motions, some of which can be large enough to deform the shape of the tub, knowing that these are generally manufactured by thermoplastic injections, the most popular being polypropylene. So, for example, when the basket is turning at a high speed in order to achieve centrifuge it is very common that the weight of articles to be washed in the basket cause an imbalance of the system, which cause the basket to not only have a rotational movement but also a translational one within the tub, even causing possible scraping against the tub's internal wall, not a desired effect of the design. If this occurs in addition to the deformation caused in the tub's mouth, the gap between the basket and the tub is greatly reduced.

This is why it is necessary to design a tub for a top loading washer which is highly rigid, not discounting the difficulty of manufacture, using thermoplastics like polyethylene or polypropylene, which help absorb, distribute and transmit the different forces and efforts created by the varying washing and centrifuge cycles.

Various efforts in this area have taken place with said objectives in mind, such as Paul Gregory Hall's AU2006235808 patent application which deals with a pumping system which is fastened to the lower portion of the tub; FIG. 2 shows a cross section of the lower portion of the tub where the reinforcements of the inferior external part of the tub can be seen, where a pancake type motor is grasped emphasizing the pump's assembly, the part of particular interest in this tub being the use of lobes in the tub's superior part which are aligned with the reinforcement of the support ears.

Jonathan David Hartwood's et al EP 1 783 264 A2 published patent application which presumably shows in FIG. 2, the same tub as Hall's, where there appear a pair of lobes aligned with the ear reinforcements, wherein said lobes were presumably designed to create more space for the basket inside the tub, given their number, as it only is comprised of two lobes which do not significantly increase the area's rigidity in the tub's mouth, allowing a larger space to the basket as well as to the tub's cover which can house a grid, window or passage in the precise additional area created by the lobes intended to transport chemicals deeper into the tub to be mixed with greater ease.

Even so, though the tubs shown in both documents at a simple glance appear to have strong reinforcements at the ears making them better able to hold heavy loads, no concern seems to be given to avoiding the deformation neither to the tub's mouth nor to the tub's cylindrical wall with an end result of attaining a more rigid tub which supports, absorbs, cushions and transmits the forces generated inside the basket while washing or centrifuge motions take place.

Given the above discussion, the need to develop a tub with higher rigidity yet using the traditional manufacturing materials, thereby reducing cost becomes apparent. The tub also allows for larger baskets to be held due to lesser deformities and thus transmits more efficiently the efforts to the suspension rods with shock absorbers, and also avoids the scraping between the tub and the basket during centrifuge, where larger baskets allow for larger washing loads as well as water and detergent (mixes water with chemicals or additives), allowing for larger washing loads in an equal volume sized cabinet, this being the purpose of this invention.

BRIEF DESCRIPTION OF THE INVENTION

Derived from the experience of designing and manufacturing washers it is noted that the tub, far from being solely an object which contains water and detergent, has structural functions as well. It supports the basket's assembly which is aligned with the tub in its symmetrical axis, as well as to the transmission or reduction box which can be fitted to the agitator; it also supports the electric motor, hoses, overflow ducts etc. This entire group afore mentioned plus the suspension rods are known as the sub-washer. The tub itself hangs from four suspension rods whose lower area has a shock absorber mechanism, whereas the higher section of said suspension rods are attached to the upper corners of the cabinet which statically and kinematically support the sub-washer. The lower area of the suspension rods are fastened to the tub by means of ears lodged in the shock absorbers, this system allows the tub at least three degrees of freedom, because if it were a rigid assembly, the washer would tend to "walk" or jump, not being capable of softening the vibrations emerging from its own operation, such as those being created from the agitation of the wash load itself or the centrifuge stages.

This is why the tub is comprised of a robust system of reinforced ears with veins which run along its length as well as the tub's circumference.

Another characteristic of the tub discussed in the present invention, are reinforcements running like a belt on the external periphery of the tub's cylindrical wall, which discourage possible deformations to said tub, and knowing that water's own weight exerts a force on said wall, coupled with certain washing conditions which require hot water for proper stain removal or to activate chemicals or detergents mixed in the wash, said temperatures can reach near 60° C., which can cause a considerable re-softening in the equatorial area of the tub's cylindrical wall inflating it to a balloon shape, not a desirable deformation because when this happens, the tub's mouth itself tends to deform inwardly reducing the gap or area between the basket and the tub, which in turn creates friction due to scraping between these two parts during the agitation and specially centrifuge motions which leads to wear out and possible permanent damage as a hole can be formed on the cylindrical wall where the repeated and prolonged scraping take place.

Another characteristic to be outlined, are the higher petal lobes located in the tub's mouth which allow the tub's mouth higher rigidity avoiding deformities to the tub's mouth caused by the basket's rotations, widening the gap between the tub and the basket precisely in the area where the basket's nodding occurs considerably avoiding the friction due to scraping between the tub and the basket. To help avoid deformities to the tub's circular wall between the lobes and over the reinforcement belt, reinforcements are placed in arc form. These reinforcements allow for the distribution of forces created by the dynamic and hydrostatic charges allowing for a better transmission of these to the shock absorbers of the suspension rods.

Yet another aspect of the present invention is found in the tub's bottom crafted as a truncated cone which allows drainage and guides the washing mixture unto the lower area, followed by an inclined plane which then guides the washing mixture towards a trough, where the valves or the pumps are fed.

On the opposite side of the tub's bottom, that is, the deep exterior, a reinforcement of a series of ribs is found which allow for extraordinary rigidity using minimum material. In this way, the elements herein described coupled with others to be detailed later, constitute the present invention creating a robust top loading washing machine with exceptional structural rigidity which allows for withstanding of high temperatures of washing mixtures without causing major deformities, high work effort, a reduced gap between the tub and the basket which allows for significant water conservation while being able to use a smaller volume tub, among other attributes.

BRIEF DESCRIPTION OF DRAWINGS

These and other characteristics, aspects and advantages of the present invention will be better understood upon reading the following detailed description referencing the accompanying drawings in which.

DETAILED DESCRIPTION

Figure 1:
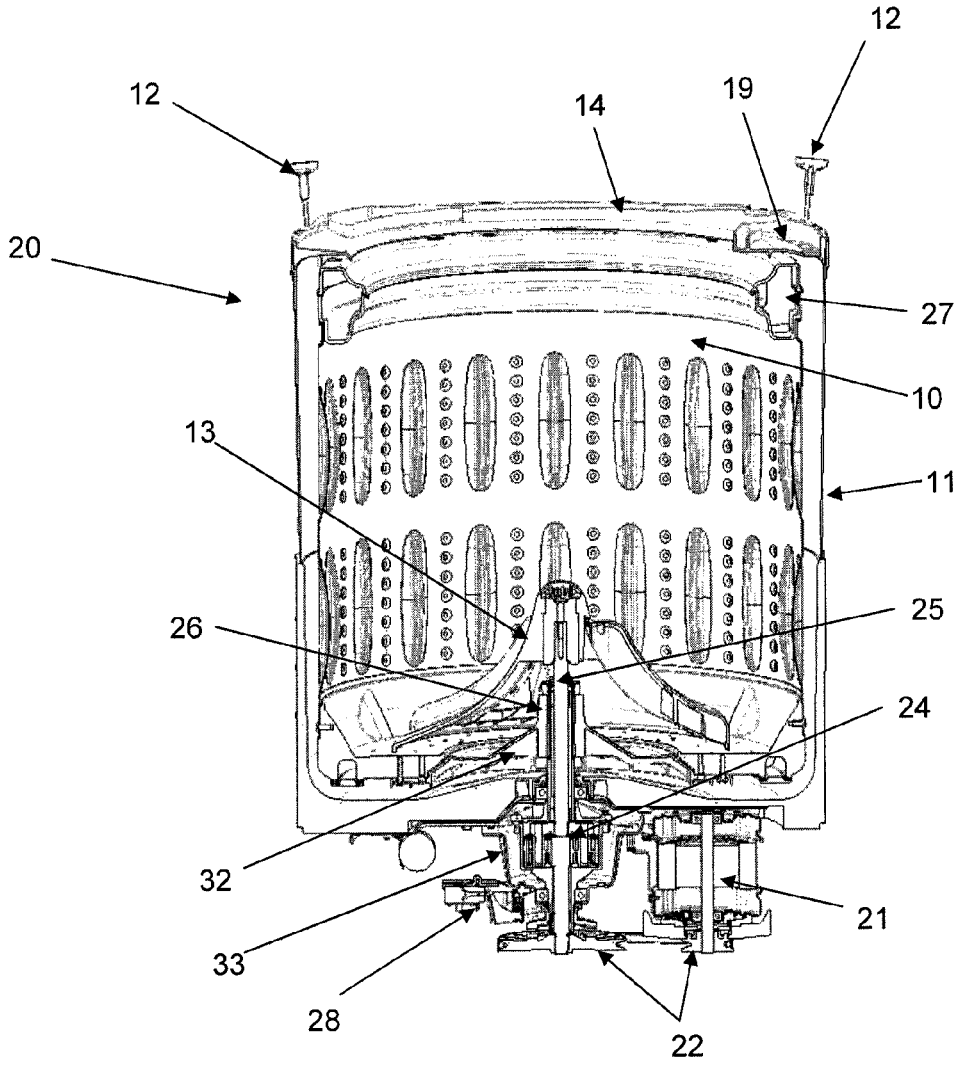
FIG. 1 is an isometric cross-section of a sub-washer.

The washing machine being described in the present invention, illustrated in FIG. 1, is a top loading machine or vertical axis, and possesses a cabinet from which four suspension rods 12 are attached, said suspension rods 12 support the tub's weight 11 with the additional accessories to said cabinet, said suspension rods in addition of supporting static charges, mitigate the dynamic charge through shock absorbers present in its lower part, which help dissipate the vibrations caused by the washing motions.

Thus the tub 11 is hung from the suspension rods 12 by means of ears 35 placed in the lower portion of said tub 11. The remaining peripheral equipment is mounted on said tub 11, such as the motor 21, in a preferred embodiment, a planetary gear for reduction 24, which, in an alternative embodiment of the present invention, can be omitted thereby adjusting the pulley relationship 22; in this form, the pulley 22 with the largest diameter will be adjusted over the internal shaft 25 which will receive energy proceeding from the electric motor 21 thanks to the arrangement of pulleys 22 and band. In a preferred embodiment the shaft 25 on its upper part shall be coupled to a planetary gear for reduction 24 with the purpose of reducing angular speed, thereby accomplishing greater torque the exiting shaft from the planetary gear for reduction which reintegrates into one shaft 25, on whose upper part the agitator is placed 13. In an alternative embodiment the internal shaft 25 has a pulley with the largest diameter coupled to its lower part 22 and on its upper part is coupled to the agitator 13. The interior of the hollow shaft 26 houses the internal shaft 25. Said hollow shaft 26 is mechanically coupled to a clutch 28, which can make both shafts 25, 26 rotate together or independently, and also said hollow shaft 26 is mechanically coupled to the basket's center called the "hub" 32, so that when shafts 25, 26 are clutched and rotating together, the hollow shaft 26 shall transmit energy to the basket 10 so that it turns along with the agitator 13.

The basket 10 is crowned with a balance hoop 27 which counteracts the unbalancing caused by the shifting of the wash load inside the basket 10. In a preferred embodiment, the tub 11 on its upper part is joined to a covered tub which houses a grill 19 and a spray deflector 18. The cabinet itself is covered with the main cover 30 which covers the washer's upper part 20, said main cover 30 serves as a support to the crest (not shown) wherein the electric components such as the controls 40, the interrupting or relief drivers, the pressure switch 41 etc are housed as well as the washer's cover or lid 29 through which the items to be washed shall be loaded.

Figure 3:
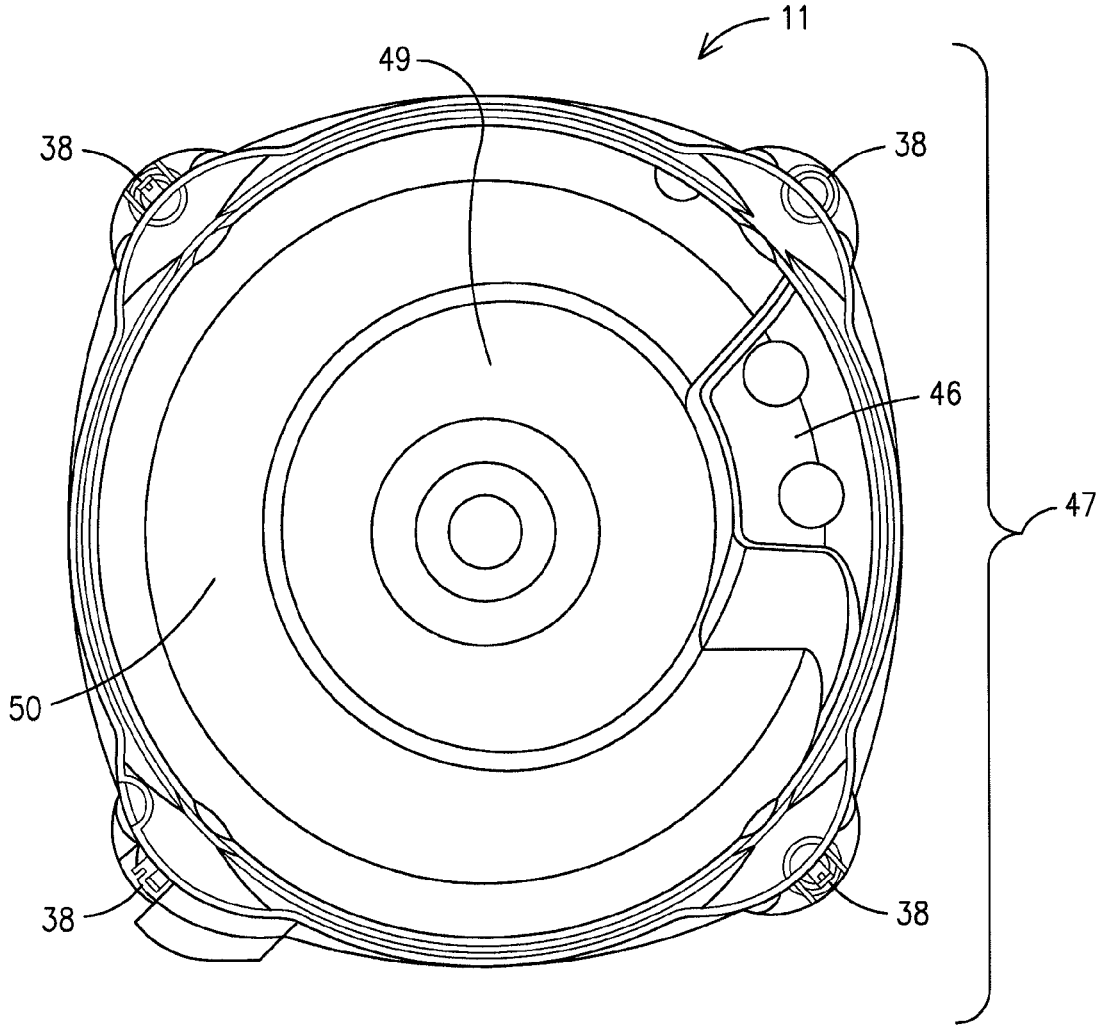
FIG. 3 is an upper view of the tub.
Figure 4:
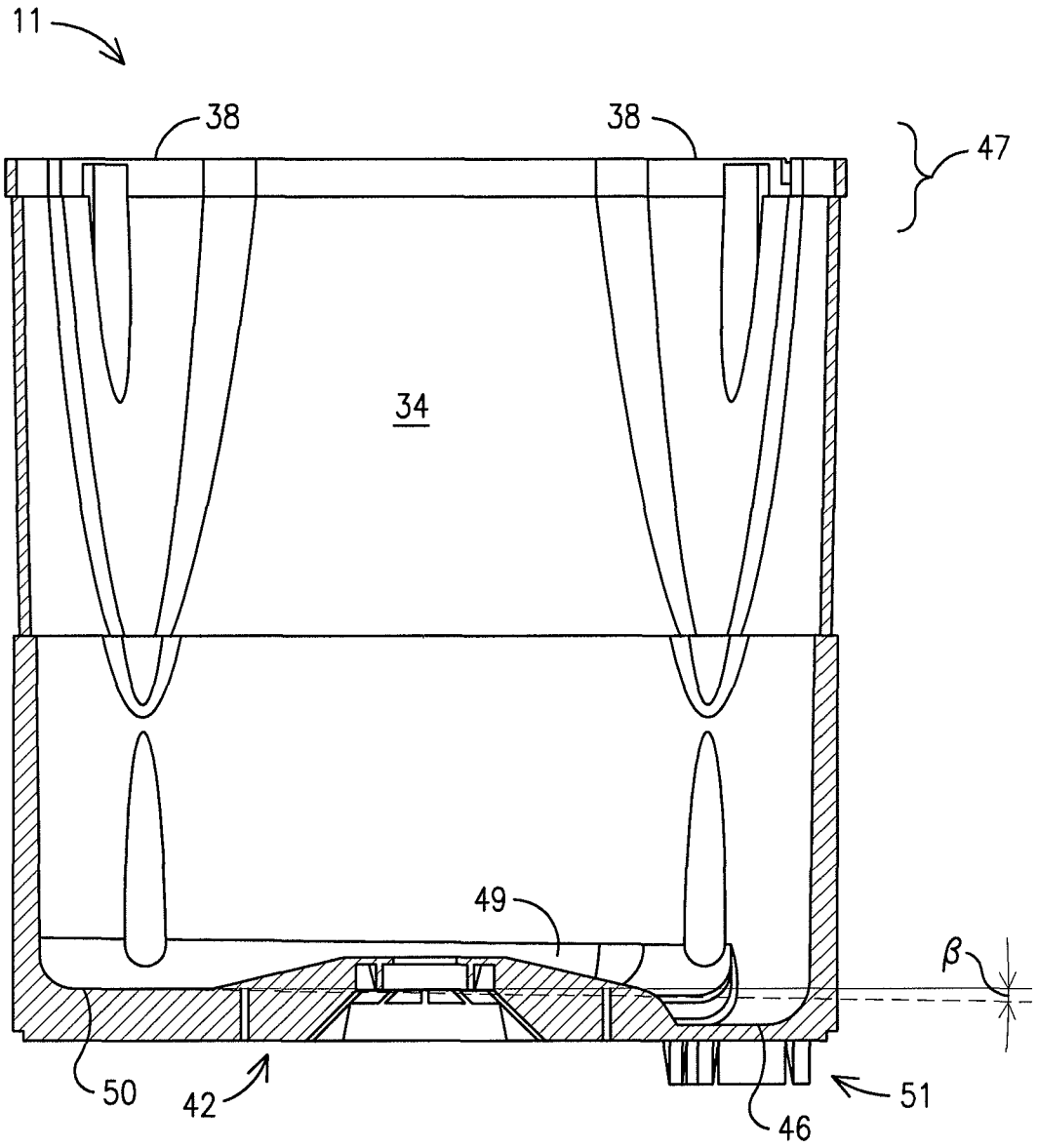
FIG. 4 is a lateral cross view of the tub.
Figure 6:
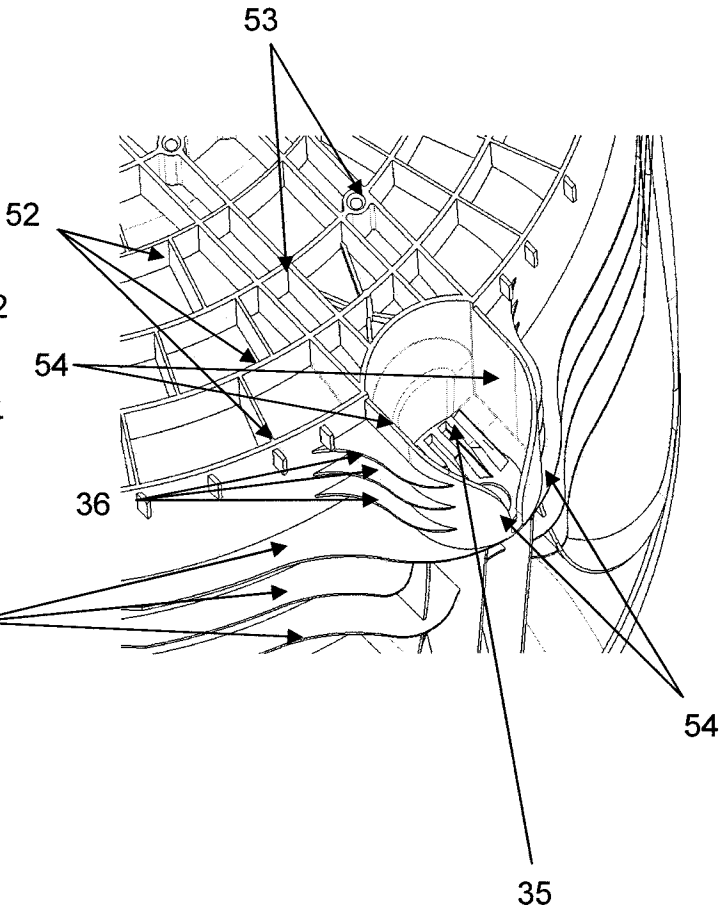
FIG. 6 is a detailed view of the lower part of the tub, specifically that of the ear.
Figure 5:
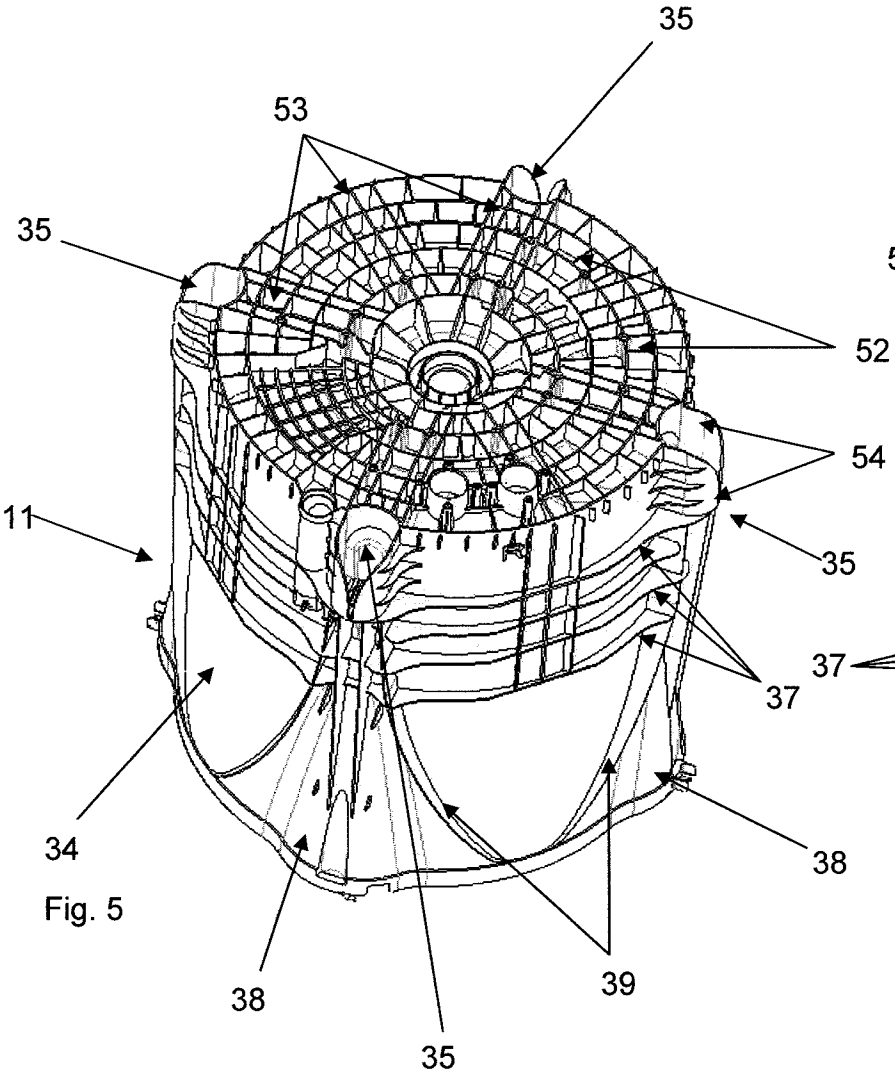
FIG. 5 is an inferior isometric view of the tub.
Figure 7:
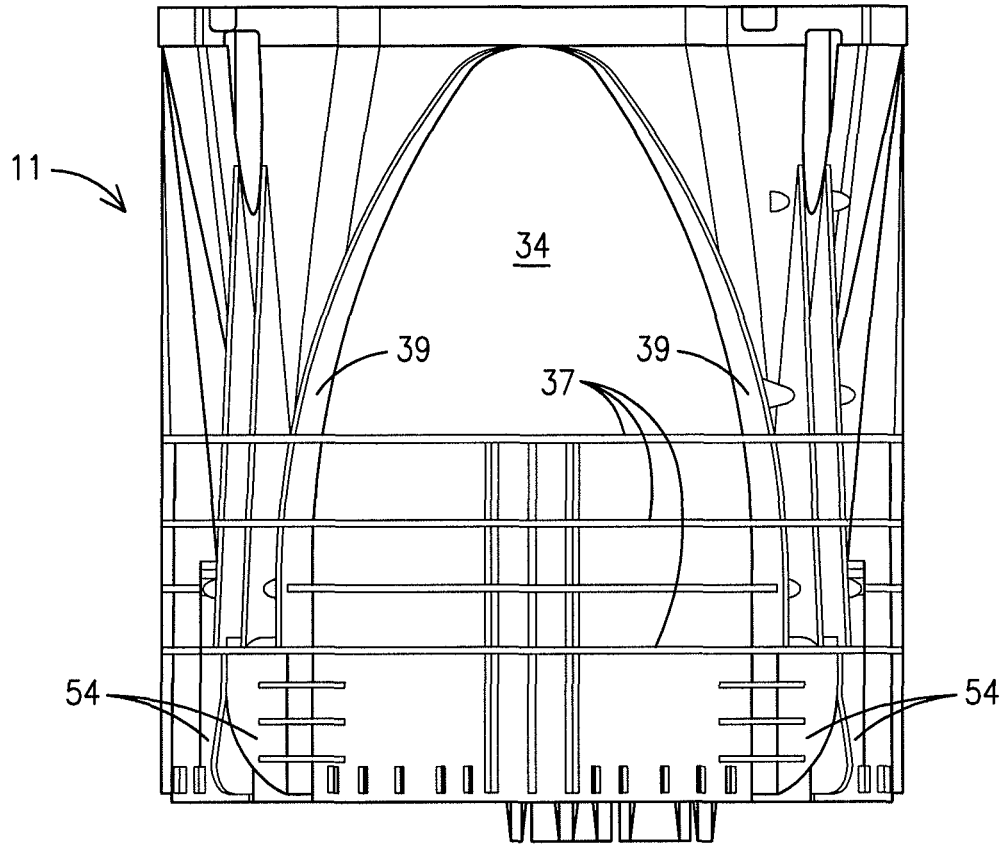
FIG. 7 is a lateral view of the tub.
Figure 8:
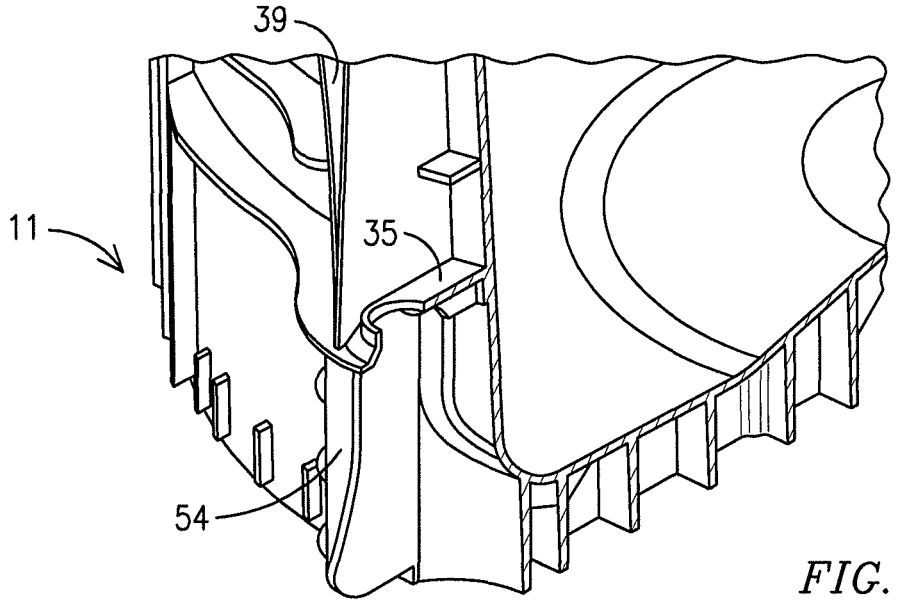
FIG. 8 is a detailed cross section of the tub's ear.
Figure 9:
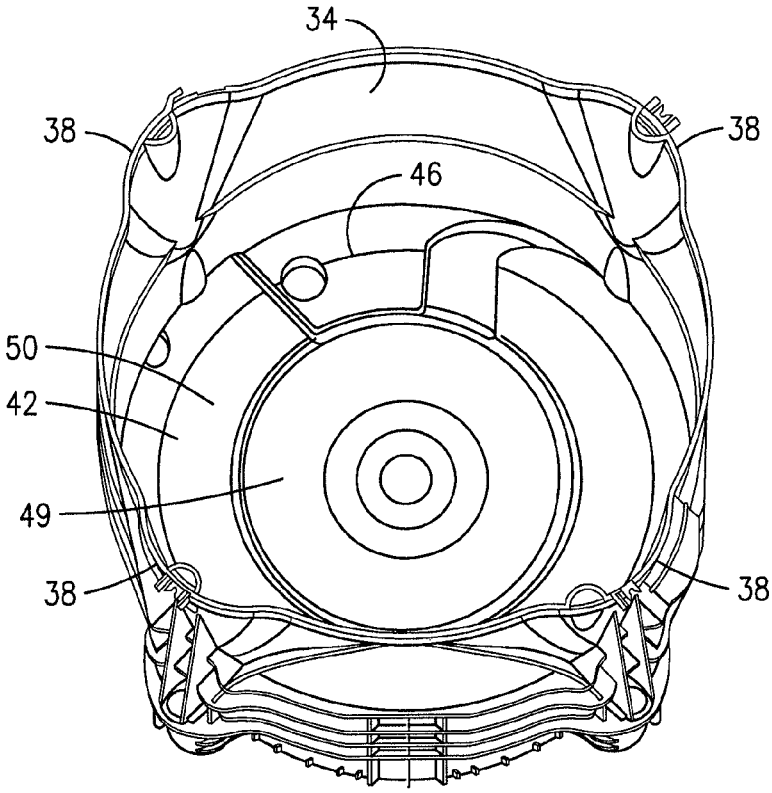
FIG. 9 is an upper isometric view of the tub.

As can be seen in FIGS. 3, 4 the tub's bottom 11 which is crafted in its center by a truncated cone 49 which allows the liquid or washing mixture to slide to a lower area aided by the force of gravity, this lower zone is formed by a ring 50 having an inclined surface relative to a horizontal plane (example inclination may be represented by the angle β shown in FIG. 4) and whose lowest point coincides with the entrance to the trough 46, wherein the liquid or washing mixture is collected to be extracted by a pump 15 whether it be for drainage or whether the liquid or washing mixture be transported to the spraying system. FIG. 5 shows the tub's lower side 11 and it is here that the series of reinforced ribs which have been implemented can be seen. It should be highlighted that a series of diametrical ribs 53 have been traced in cross shape. That is to say, they emerge from the sides of the ears 35, as can be seen in FIG. 6, and cross diametrically at the opposite ear 35, discontinuing the ribs as they pass through the center, the remaining being the radial ribs 52. In a preferred embodiment to the present invention, another set of diametric ribs 53 emanate from the tub's center 11 towards the periphery of the tub's bottom 42, said diametric ribs 53 are preferably traced precisely in the middle of the diametric ribs which go from ear 35 to ear 35. This intricate rib arrangement gives the bottom of the tub 42 greater rigidity with a minimum amount of material used. Using this intricate rib arrangement ensures the placement of sufficient material in the precise area where the forces require strength.

Figure 1A:
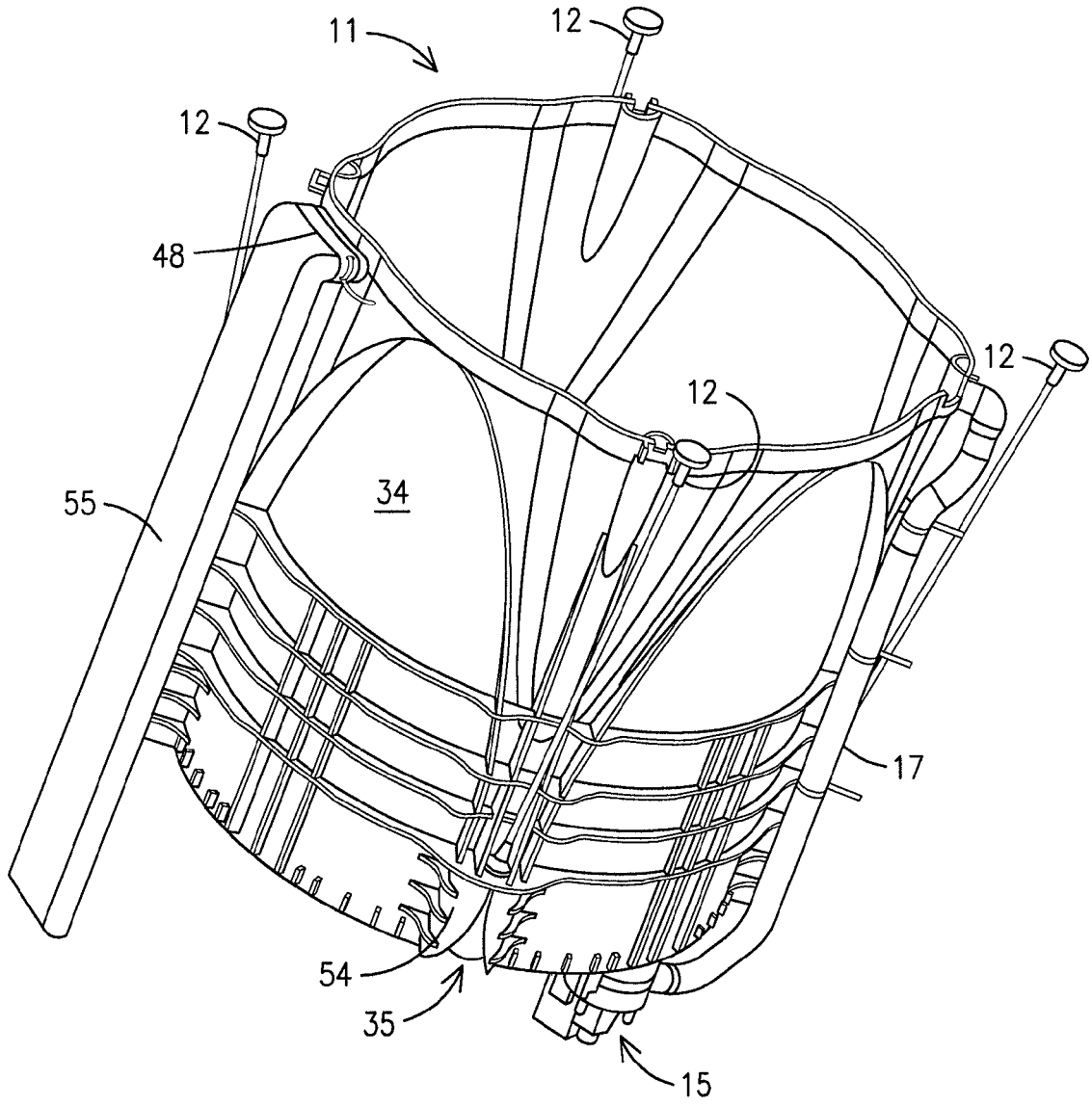
FIG. 1*a* is an isometric representation of the tub with suspension rods, a drainage duct and a spraying hose.
Figure 2:
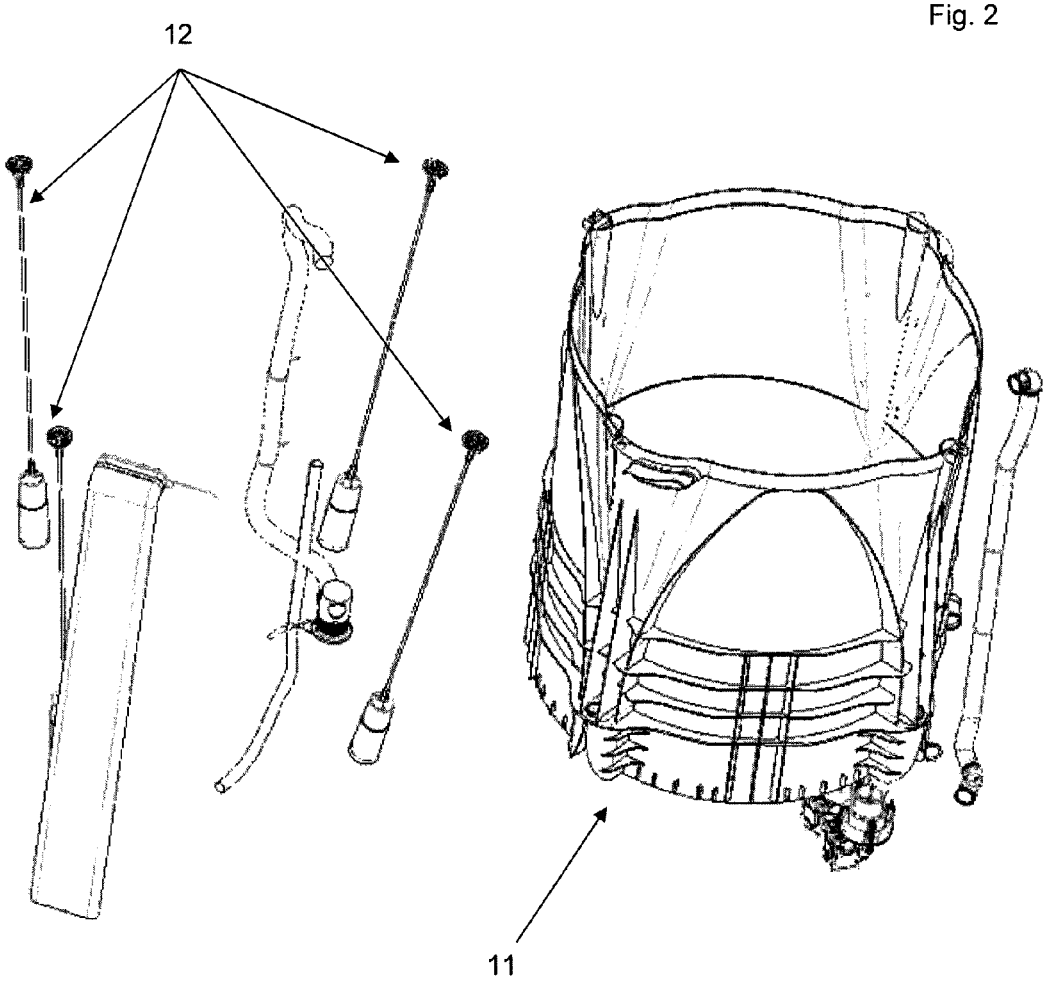
FIG. 2 is an isometric representation of the tub with suspension rods, an overflow duct, a spraying hose and an exploded drainage system.

The ears 35 can be seen in FIGS. 1*a*, 5, 6, 7, 8. It should be noted that said ears 35 are formed by a pair of petals 54 which wrap the shock absorbers from the suspension rod 12 as can be seen in FIG. 1*a*. Said petals have the end result of distributing the final dynamic forces, that is, the forces which are generated when the washer is in a wash, centrifuge or rinse mode. In this way, said dynamic forces are not transmitted in their full capacity to the suspension rods' 12 shock absorbers, but rather, are diluted into the tub's body 11.

That is, the suspension rod's 12 shock absorber makes contact on a horizontal plane which protrudes from the ear 35. The lower side of said plane has a spherical surface which has an opening which can be coupled in a swivel form to the upper side of the suspension rod's shock absorber 12. Said aperture allows the suspension rod access through said horizontal plane of the ear 35 allowing it enough space to allow for angular movement on the vertical axis, this being one degree of freedom: a second and third degree of freedom are obtained on the horizontal axis, allowing the tub 11 a limited translational movement.

In this way, this system ensures restricted amplitude of movement with 3 degrees of freedom, not allowing movement in the 3 remaining degrees of freedom. However, if the horizontal plane protruding from the ear 35 could be formed as a cantilevered beam (see FIG. 8) this would create a strong lever arm on the tub's 11 cylindrical wall 34 and create large forces on the tub's bottom 42. In a best case scenario, this can cause deformities to said tub's parts 11, which once said applied forces cease being applied, will return to its original shape. In another case, said deformities can be permanent or cause premature fatigue on said parts of the tub 11. With the intent of reinforcing said protrusion from the ears 35 on the horizontal plane a pair of petals 54 are added to the ear which help distribute the dynamic forces over a greater area on the tub's 11 cylindrical wall 34.

The mentioned petals possess an alternative embodiment from the present invention with reinforcement ribs 36. The distinct shape of these ears 35 allow a better way to transmit the forces concentrated there unto a larger area of the tub's 11 cylindrical wall 34 and also restrain them to some degree from reaching the deepest part of the tub 42, lessening the lever's effect on said deepest part 42. As can be seen from the previous discussion as well as from the figures, this design can transmit to a great degree the forces on the tub 11 and dissipate them unto the tub's body transmitting these forces to a lesser degree on the suspension 12. The ears' robust design 3 is more difficult to deform, thereby increasing the tub's life, lessening fatigue and additionally increasing the tub's total rigidity 11.

Another facet of the present tub's 11 invention, making reference to FIGS. 1*a*, 2, 5, 7, 8 is based on the arch shaped reinforcements 39 which can be directed on the external side of the tub's 11 cylindrical wall 34. Said arch's base is precisely on the side of the ear 35, which itself serves as reinforcement to the ear 35. It should also be noted that the lower part of the arch 39 presents a greater radial height, this helps increase moment of inertia in the lower part, which in turn helps the rigidity of the tub's lower part as well as aids in the distributing of forces over a greater area. Thus, when the arch's curvature increases in height over the tub's 11 cylindrical wall 34, radial height decreases, understanding that the upper portion of the tub 11 does not require high rigidity, therefore being able to economize material with this design, as well as allowing for coherent distribution of dynamic and static forces. The arch as can be discerned, can be formed in different curvatures and configurations, the preferred curvature shall depend on the particular design of each tub, depending on variations of the ear's 35 design, the presence or lack of belts or cylindrical reinforcements 37, and in case of the actual configuration of these, on the design of the mold itself, are among other factors which can alter the shape or curvature of the arch 39, which is built with the best possible shape to ensure the best distribution of forces on the tub's 11 cylindrical wall 34.

Now turning attention to the belts or cylindrical reinforcements 37 shown in FIGS. 1*a*, 2, 5, 6, 7, 8 it can be seen that said belt or cylindrical reinforcements 37 can be developed preferably in the tub's lower part 11 surrounding the cylindrical wall 34. The reinforcements 37 are ribs in rectangular or trapezoidal transverse sections, which protrude in radial shape from the cylindrical wall's 34 exterior surface. This allows for a greater moment of inertia giving the mid to lower area of the cylindrical wall 34 excellent rigidity which decreases the deformations caused to this area of the tub 11 and also allows for more efficient distribution of dynamic and static forces to which said tub 11 is subjected to.

The lobes 38 shown in FIGS. 1*a*, 3, 4, 5, 9, 10, 11 in addition to giving rigidity to the tub's 11 mouth 47, confer a greater action radius to the basket 10, since it is precisely in this area where the gap or space between the tub 11 and the basket 10 is decreased when the basket spins, this is due to the basket's 10 head movement which has its greatest translation movement on the horizontal plane at this point, taking into account that said basket 10 is fastened in its lower or deepest part to the hollow shaft 26. So that when a considerable shift in the wash load causes imbalance within the basket 10, the translational movement of the basket's 10 upper part is exacerbated and can indeed scrape the tub's 11 mouth 47 causing the tub 11 harm such as perforations to the cylindrical wall's 34 higher interior surface or in the best of scenarios, loss of energy due to friction caused by the surface contact between the tub 11 and the basket 10. Thereby the lobes increase the space within which the basket 10 in case of being subjected to translational movement due to its imbalance, avoid to a great degree the scraping problem and as has been mentioned before, increase to a great degree the rigidity of the tub's 11 mouth 47, which in a common tub 11 or one which does not possess said lobes 38 nor the arch 39, due to the weight or static and kinematic forces which are transmitted to the tub 11 originating from the basket 10 when it is loaded with articles to be washed submerged in the washing mixture coupled to the lever arms which are generated in supporting the tub 11 to the suspension rods through the ears 35, cause the tub's 11 mouth to lose its cylindrical shape tending to collapse inwardly or along the tub's 11 own symmetrical axis. In this way, said lobes 38 help avoid the inconveniences mentioned above.

Figure 10:
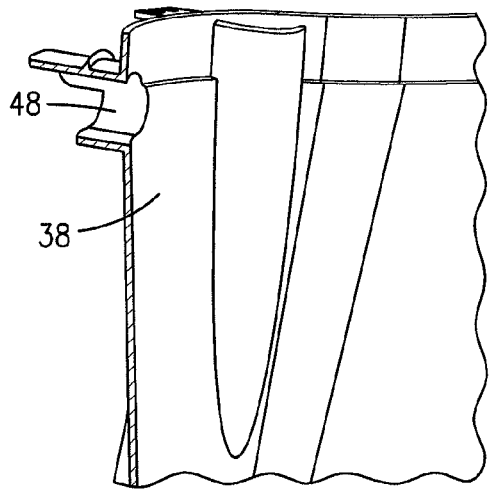
FIG. 10 is a detailed cross-section of the overflow drain.
Figure 11:
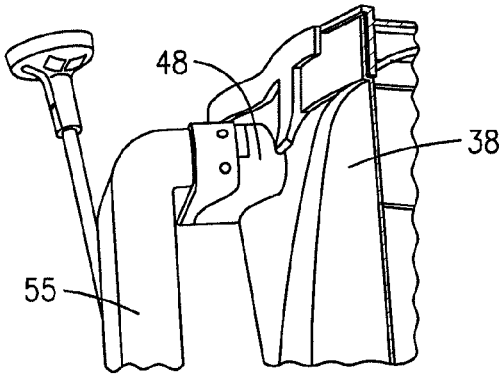
FIG. 11 is a detailed view of the assembly of the drainage duct unto the overflow drain.
Figure 12:
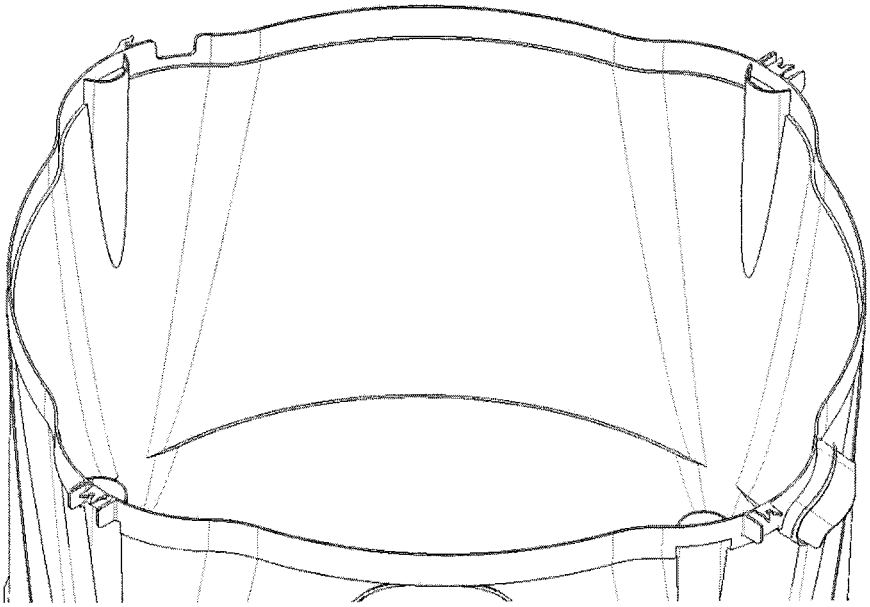
FIG. 12 is a detailed isometric view of the tub's mouth.

The tub's 11 mouth 47 has an interesting spout 48, which has the function of draining the washing mixture or liquid contained in the tub 11, which for whatever reason is found in excess guaranteeing a maximum level of washing mixture or liquid within the tub 11. This spout acquires particular relevance since it avoids, should the operator overfill the system with water or in case the pressure switch 41 or the full capacity valve 45 or electronic control 40 malfunction and cause the overfilling of water above the tub's 11 maximum water capacity and the washer 20 can then carry out the washing and rinsing functions. Said liquid or washing mixture excess has to be drained because otherwise the liquid or washing mixture can overflow from the tub 11 over its upper part with the liquid or washing mixture sliding in fountain form over the exterior surface of the tub's 11 cylindrical wall 34, possibly causing the pumps or motors among other electrical devices to become wet when the overflow of liquid or washing mixture moistens the floor where the washer 20 is placed causing this flow of events to create a dangerous situation, which in a worst possible outcome, could lead to the operator's electrocution since the liquid or washing mixture previously mentioned, has a high water content and water is an electric conductor. In order to avoid such a dangerous situation, the spout 48, has been designed as shown in FIGS. 1*a*, 10, 11, as coupled via a ring, clasp or another securing mechanism to a sleeve 55, which itself is a tube preferably made from a polyethylene extruded with low density, similar to a plastic bag with no bottom. Said sleeve 55 transports the excess liquid or washing mixture to the washer's 20 lower part.

Having fully described the present invention, it is found to attain a high degree of inventive activity, its industrial application undeniable, warning at the same time that a technician with knowledge in the area can discern alternative modalities which shall be included within the reach and spirit of the following claims.

The invention claimed is:

1. A washer tub having a cylindrical wall which is suspended by suspension rods, the tub comprising:

A) at least three ears from which the tub is supported by the suspension rods on one end;

B) at least one cylindrical reinforcement which circumferentially surrounds the cylindrical wall and has a major dimension projecting perpendicular to said wall;

C) at least one arch on the cylindrical wall, said at least one arch having a major dimension projecting perpendicular to said wall, wherein a base of said at least one arch is positioned so that a first end of said at least one arch abuts a first ear of said at least three ears, and a second end of said at least one arch abuts a second ear of said at least three ears; and D) at least one pair of lobes substantially on an upper area of the tub, wherein a crown of the arch opposite the base of the arch is disposed proximate the upper area of the tub to reinforce an area of the cylindrical wall of the tub positioned intermediate relative to said at least one pair of lobes.

2. The tub according to claim 1, further comprising at least one spout for over-flow disposed substantially on the upper area of the tub.

3. The tub according to claim 1, wherein said ears have one or more rib reinforcements.

4. The tub according to claim 1, further comprising at least one radially-extending rib on the underside of the tub.

5. The tub according to claim 1, further comprising at least one diametrically-extending rib on the underside of the tub.

6. The tub according to claim 1, where the tub has a bottom in the shape of a ring having an inclined surface configured to transport liquid within the tub to a trough.

7. The tub according to claim 6, wherein at least one pump support is disposed below the trough.

8. A household washer comprising a tub according to claim 1.

9. The tub according to claim 1, wherein the major dimension of said at least one arch decreases as the arch extends from its base to its crown.

10. The tub according to claim 1, wherein a number of further cylindrical reinforcements and said at least one cylindrical reinforcement are spaced apart from one another and distributed over the cylindrical wall of the tub from a mid-area to a lower area of the tub, wherein said at least one arch is interconnected to the cylindrical reinforcements at respective mutually intersecting points.

11. The tub according to claim 10, wherein at least one of said at least three ears is integral to one of the cylindrical reinforcements.

* * * * *